US007714178B2

(12) United States Patent
Bylicki et al.

(10) Patent No.: US 7,714,178 B2
(45) Date of Patent: May 11, 2010

(54) METHOD OF OBTAINING HIGH-QUALITY PRODUCTS FROM POLYOLEFIN WASTE MATERIAL OR POLYOLEFINS

(75) Inventors: Andrzej Bylicki, Warsaw (PL); Edwin Kozlowski, Gliwice (PL)

(73) Assignee: Clariter Poland SP. Z O.O., Warsaw (PL)

( * ) Notice: Subject to any disclaimer, the term of this patent is extended or adjusted under 35 U.S.C. 154(b) by 653 days.

(21) Appl. No.: 11/571,202

(22) PCT Filed: Oct. 9, 2003

(86) PCT No.: PCT/PL03/00105

§ 371 (c)(1),
(2), (4) Date: Jan. 26, 2007

(87) PCT Pub. No.: WO2004/037906

PCT Pub. Date: May 6, 2004

(65) Prior Publication Data

US 2009/0120837 A1 May 14, 2009

(30) Foreign Application Priority Data

Oct. 28, 2002 (PL) ..... 356875

(51) Int. Cl.
*C07C 1/00* (2006.01)

(52) U.S. Cl. ..... 585/241; 208/108; 208/131; 208/308; 585/240; 585/250; 201/25; 201/30

(58) Field of Classification Search ..... 201/2.5, 201/25, 30; 585/241, 240, 250; 588/228; 423/481, 488; 208/67, 68, 108, 308, 131
See application file for complete search history.

(56) References Cited

U.S. PATENT DOCUMENTS

| | | | | |
|---|---|---|---|---|
| 4,851,601 | A * | 7/1989 | Fukuda et al. | 585/241 |
| 5,286,374 | A * | 2/1994 | Chen | 208/400 |
| 5,738,025 | A * | 4/1998 | Tachibana | 110/346 |
| 5,811,606 | A * | 9/1998 | Yang | 585/241 |
| 5,895,827 | A * | 4/1999 | Takahashi et al. | 585/241 |
| 6,172,275 | B1 * | 1/2001 | Tadauchi et al. | 423/481 |
| 6,683,227 | B2 * | 1/2004 | Platz et al. | 585/241 |
| 6,774,271 | B2 * | 8/2004 | Jiang | 585/241 |
| 7,531,703 | B2 * | 5/2009 | Ramesh et al. | 585/241 |

FOREIGN PATENT DOCUMENTS

| | | |
|---|---|---|
| GB | 1 467 412 A | 3/1977 |
| WO | 96/01298 A | 1/1996 |

* cited by examiner

*Primary Examiner*—N. Bhat
(74) *Attorney, Agent, or Firm*—Matthias Scholl, PC; Matthias Scholl

(57) ABSTRACT

A method of producing high value products: kerosene including cosmetic kerosene, white oils, high value paraffin and purified liquid fuels, from polyolefin waste material and polyolefins, comprising (a) thermally or catalytically decomposing polyolefin waste material or polyolefins to yield vapor products; (b) condensing vapor products of thermal or catalytic decomposition of polyolefin waste material or polyolefins, to yield a first mixture; (c) catalytically hydrogenating said first mixture to reduce olefinic double bonds and acetylenic triple bonds to yield a second mixture; and (d) fractionally distilling said second mixture to yield one or more of the following: a kerosene fraction having a boiling range below 180° C., a cosmetic kerosene fraction having a boiling range of between 180 and 275° C., a white oil fraction having a boiling range of between 270 and 400° C., or a paraffin fraction having a boiling range above 400° C.

20 Claims, No Drawings

METHOD OF OBTAINING HIGH-QUALITY PRODUCTS FROM POLYOLEFIN WASTE MATERIAL OR POLYOLEFINS

CROSS REFERENCE TO RELATED APPLICATIONS

This is a National Stage Application of International Patent Application No. PCT/PL2003/000105, with an international filing date of Oct. 9, 2003, which is based on Polish Patent Application No. P.356875, filed Oct. 28, 2002.

BACKGROUND OF THE INVENTION

1. Field of the Invention

The subject of this invention is a method of obtaining high-quality products from polyolefin waste material or polyolefins, including kerosene, and in particular cosmetic kerosene, white oils, cosmetic paraffin, and other high-quality types of paraffins and aliphatic hydrocarbons. The products do not contain sulfur, nitrogen, other types of organic compounds, and double bonds. The products may be used, e.g., as components of fuels.

2. Description of the Related Art

Polyolefins are used to manufacture packages, utensils, containers, as well as construction materials.

Conventional methods of processing polyolefin waste material include thermal and catalytic destruction, which is carried out in the temperature range of between 350 and 450° C., depending on the catalyst used, to obtain a mixture of hydrocarbons, mainly aliphatic hydrocarbons of straight or branched-chain type, to be used as components of liquid fuels.

The process of thermal and catalytic destruction can be run in such a way that the liquid product obtained covers a wide range of hydrocarbons characterized by a boiling point from around 70° C. up to 600° C. These hydrocarbons are partly unsaturated and contain a considerable number of double bonds that, due to their chemical reactivity, reduce the stability of the product and cause allergy, reducing their value as components of fuels and making it impossible for them to be used to manufacture products of higher quality, including cosmetic kerosene, white oils, and paraffin.

Cosmetic kerosene is a fraction composed mainly of aliphatic hydrocarbons with the boiling temperature limit of about 180-275° C. that must meet high requirements with respect to purity, must not contain any aromatic hydrocarbons, and can contain only small amounts of sulfur compounds, nitrogen compounds, and other impurities.

White oils are oils that are composed mainly of aliphatic hydrocarbons having a high degree of purity, and having a boiling point between 260 and 400° C., that do not contain any aromatic hydrocarbons and contain only very small amounts of sulfur compounds, nitrogen compounds, and other impurities. White oils, as technical oils of a high degree of purity, are widely used in many industrial sectors as auxiliaries in technological processes, components of chemical formulations, as well as lubricants having a high degree of purity. Medical white oils of the highest purity degree are employed in food, pharmaceutical, and cosmetic industries.

Paraffin is a mixture of high-molecular weight aliphatic hydrocarbons having a boiling temperature of approximately 360-600° C.

Several types of paraffins are manufactured from refined raw products, starting from paraffin wax to cosmetic paraffin that differ from one another in having different contents of oil and impurities, such as sulfur and nitrogen compounds in particular.

Conventionally, to manufacture kerosene, including cosmetic kerosene, white oils, and paraffin, raw materials of refinery origin have been used. The raw materials must be refined in order to remove almost completely any sulfur compounds and nitrogen, as well as aromatic and unsaturated hydrocarbons. This process comprises several hydrogenation steps catalyzed by selective catalysts, mainly based on noble metals, that enable far-reaching, although not complete, removal of sulfur and nitrogen compounds.

Obtaining pure aliphatic hydrocarbons, not containing sulfur and aromatic hydrocarbons, from raw materials is a very difficult task, if at all possible on a large scale.

SUMMARY OF THE INVENTION

In one embodiment of the invention provided is a method of obtaining high-quality products from polyolefin waste material or polyolefins such as cosmetic kerosene, white oils, high-quality types of paraffin, including cosmetic paraffin and purified liquid fuels, which comprises a product of thermal and catalytic destruction of polyolefin waste material obtained in the form of vapor that is subject to fractional condensation, or after it has been condensed to fractional distillation and catalytic hydrogenation of the whole product, or the fractions obtained which hydrogenation is carried out until almost complete removal of double and possibly triple bonds takes place, and then the fractions obtained are subjected to further processing through fractional distillation in order to obtain a fraction the boiling temperature limits and the degree of purity of which correspond with these of kerosene, including cosmetic kerosene boiling at the limits of approximately 180-275° C., the fraction of white oil boiling at the limits of approximately 270-400° C. that can be possibly divided into narrower fractions corresponding with respect to physical and chemical properties, especially to viscosity and volatility, to the requirements of adequate grades of white oil and possible of the paraffin fraction which fraction is subjected to the process of deoiling, preferably with the use of presses, and possibly to fractional distillation in order to obtain cosmetic paraffin and other high-quality types of paraffin.

In certain embodiments, the process of catalytic destruction of polyolefin waste material or polyolefins comprises the use of partial condensation and recycling of heavier vapors until a significant increase of hydrocarbons with the contents of carbon in the chain within the range from $C_{10}$ up to $C_{16}$ is reached, which hydrocarbons correspond approximately to the fraction of cosmetic kerosene boiling at the limits from 180° C. up to 275° C.

In certain embodiments, the process of catalytic destruction of polyolefins or polyolefin waste material comprises the use of partial condensation and recycling of heavier vapors until a significant increase of hydrocarbons with the contents of carbon in the chain within the limit from $C_{15}$ up to $C_{25}$ is reached, which hydrocarbons correspond to the fraction of white oil boiling at the limits from 260° C. up to 400° C.

In certain embodiments, the process of catalytic destruction of polyolefins or polyolefin waste material is run without the use of partial condensation and recycling of heavier vapors in such a way that the product contains significant amount of hydrocarbons with the content of carbon in the chain above $C_{20}$, and then after the product is divided into fractions which are hydrogenated, the fraction the boiling limits of which fall between 350° C. up to 650° C. is used to obtain different types of paraffin of a high degree of purity, including cosmetic paraffin, with deoiling processes being employed, preferably with the use of presses or other well-known methods or possibly with the use of the process of fractional distillation.

In certain embodiments, the process of catalytic destruction of polyolefin waste material or polyolefins is run under conditions in which through a proper catalyst being selected or the reaction temperature increased, there occurs partial cyclization of aliphatic hydrocarbons with naphthenic or aromatic hydrocarbons being created that in the following process of hydrogenation are totally processed into naphthenic hydrocarbons and besides the aliphatic hydrocarbons they represent a component of the cosmetic kerosene, white oil and paraffin obtained.

DETAILED DESCRIPTION OF THE INVENTION

A method of obtaining high-quality products from polyolefin waste material or polyolefins according to the invention consists in the product of their thermal and catalytic destruction obtained in the form of vapor to be subjected to a process of fractional condensation or after it is condensed, of fractional distillation and catalytic hydrogenation of the whole product or the fractions obtained, which process is run until a complete or far-reaching hydrogenation of double and possibly triple bonds, if they are to be found in the product, is obtained so that the final product contains almost exclusively saturated aliphatic and partially naphthenic hydrocarbons to be next processed into high-quality products of the highest degree of purity that do not comprise any compounds of sulfur, nitrogen and other impurities. These products are represented by cosmetic kerosene, white oils, and high-quality types of paraffin, including cosmetic paraffin.

The aliphatic hydrocarbon fractions obtained after hydrogenation and removal of double bonds or fragments of these fractions, that remain after the fractions corresponding to cosmetic kerosene, white oil and paraffin have been isolated through distillation, may be used as purified liquid fuel that does not contain any compounds of sulfur and nitrogen and unsaturated hydrocarbons.

In order to increase in the product of thermal and catalytic destruction the content of lower-boiling hydrocarbons corresponding to the fraction of kerosene and white oil, it is advised to condense partly and recycle the product obtained in the form of vapor which results in deeper destruction and the content of hydrocarbons boiling at the temperature above 400° C. in the product to be confined or eliminated.

The partial condensation and recycling of heavier vapors in a thermal and catalytic destruction reactor is carried out in such a way as to increase in the product especially the content of hydrocarbons of the carbon content in the chain mainly within the range $C_{10}$ up to $C_{16}$ which corresponds to the fraction of kerosene boiling at the range from 180° C. to 275° C., or in such a way as to increase in the product the content of hydrocarbons of the carbon content in the chain mainly within the range $C_{15}$ up to $C_{25}$ corresponding to the fraction of white oil, boiling at the temperature limits of 260° C.-400° C. In order to obtain in the product a significant amount of hydrocarbons of the carbon contents in the chain above $C_{20}$ corresponding to the paraffin fraction boiling within the limit of 360° C.-600° C., the process of catalytic destruction of polyolefins or polyolefin waste material is run without heavier vapors being partly condensed and recycled.

The processing of polyolefin waste material or polyolefins may be carried out in such a way as to enable it for the product to contain apart from aliphatic hydrocarbons also naphthenic groups of hydrocarbons. For this purpose, the process of thermal and catalytic destruction of polyolefins or polyolefin waste material is run under conditions in which, e.g., by a specially-selected catalyst or by reaction temperature increased a partial cyclization of aliphatic hydrocarbons takes place with naphthenic or aromatic hydrocarbons being created that in the following process of hydrogenation are totally processed into naphthenic hydrocarbons, and besides, aliphatic hydrocarbons constitute a component of the cosmetic kerosene, white oil, and paraffin obtained.

Products of thermal and catalytic destruction of polyolefins and polyolefin waste material represent especially suitable raw material for obtaining cosmetic kerosene, while oils, and high-quality paraffin products, including cosmetic paraffin, since they do not contain sulfur and nitrogen compounds and possible organic and inorganic impurities. Further, it is necessary to remove double bonds through hydrogenation which is easily accomplished by using nickel catalysts or other types of industrial catalysts available, as well as by using fractional distillation to obtain products of the required limits of boiling temperatures.

The methods allow for obtaining products of new quality and high environmental value and purity, which are difficult to be obtained from petroleum raw materials.

EXAMPLES

Example I

Product of thermal and catalytic destruction of polyolefin waste material obtained in the form of vapor is subjected to partial condensation of higher-boiling vapors and recycling so that the obtained product is contained within the limit of the boiling temperature 70° C. up to 400° C., and then the product vapors are subjected to fractional condensation with the division into two fractions: the fraction boiling within the limit up to 270° C. and the fraction boiling within the limit from 270° C. up to 390° C. The fractions are separately subjected to the process of catalytic hydrogenation using a nickel catalyst at the temperature of 160° C. under the pressure of 80 atm until double bonds are removed to the content below 1%, which process is to be carried on a continuous basis with the hydrogenation product obtained being checked for the content of double bonds using infrared spectrometry. The fractions obtained, the boiling limits of which are changed due to the hydrogenation of dual bonds, are subjected to fractional distillation in order to obtain cosmetic kerosene that boils within the boiling limits from 180° C. up to 275° C., and white oil that boils within the boiling limits from 270° C. up to 380° C., as products of the highest degree of purity that do not contain any aromatic hydrocarbons and compounds of sulfur and nitrogen. The fraction boiling within the limits up to 180° C. is used as a component of fuels.

Example II

Product of thermal and catalytic destruction of polyolefin waste material obtained in the form of vapor is subjected to fractional condensation with the division of the following three fractions: the fraction boiling within the limits up to 280° C., the fraction boiling within the limits from 280° C. up to 380° C., and the fraction boiling above 380° C. The fractions are separately subjected to the process of catalytic hydrogenation using a nickel catalyst at the temperature of 160° C. under the pressure of 80 atm until double bonds are completely hydrogenated, which process is to be carried on a continuous basis with the hydrogenation product obtained being checked for presence of double bonds using infrared spectrometry. The fractions obtained, the boiling limits of which are changed due to the hydrogenation of dual bonds are subjected to fractional distillation in order to obtain cosmetic kerosene that boils within the boiling limits from 180° C. up to 275° C., white oil that boils within the boiling limits from 270° C. up to 380° C., and the paraffin fraction that boils within the boiling limits from 380° C. up to 620° C., as products of the highest degree of purity that do not contain any aromatic hydrocarbons and compounds of sulfur and nitrogen and double bonds. The paraffin fraction is subjected to de-oiling with the use of a press until a high-quality paraffin of the solidification point above 50° C. and the content of oil below 2% is obtained. The fraction of the boiling temperature limit up to 180° C. is used as a component of fuels or as a solvent of a high degree of purity for cosmetic and other purposes.

The invention claimed is:

1. A method of obtaining high-quality products from polyolefin waste material or polyolefins, said method comprising the following steps in the order listed:

(a) thermally or catalytically decomposing polyolefin waste material or polyolefins to yield vapor products;

(b) condensing vapor products of thermal or catalytic decomposition of polyolefin waste material or polyolefins, to yield a first mixture;

(c) catalytically hydrogenating said first mixture to reduce olefinic double bonds and acetylenic triple bonds to yield a second mixture; and (d) fractionally distilling said second mixture to yield one or more of the following: a kerosene fraction having a boiling range below 180° C., a cosmetic kerosene fraction having a boiling range of between 180 and 275° C., a white oil fraction having a boiling range of between 270 and 400° C., or a paraffin fraction having a boiling range above 400° C.

2. The method of claim 1, wherein if the condensate in step b contains sulfur, additionally removing said sulfur by hydrodesulfurization before hydrogenating said first mixture.

3. The method of claim 1, wherein said white oil fraction his divided into a plurality of white oil grades.

4. The method of claim 1, wherein said paraffin fraction is further subjected to a process of deoiling with the use of a press.

5. The method of claim 1, wherein said paraffin fraction is further subjected to fractional distillation to yield cosmetic paraffin and other high-quality types of paraffin.

6. The method of claim 1, comprising further in step (a), partially condensing and recycling heavier vapors, whereby significantly increasing ratio of C10-C16 hydrocarbons in the vapor products.

7. The method of claim 1, comprising further in step (a), partially condensing and recycling heavier vapors, whereby significantly increasing ratio of C15-C25 hydrocarbons in the vapor products.

8. The method of claim 1, not comprising in step (a) partially condensing and recycling heavier vapors, whereby significantly increasing ratio of hydrocarbons above C20 in the vapor products.

9. The method of claim 1, comprising further in step (a), partially cyclizing aliphatic hydrocarbons to yield naphthenic or aromatic hydrocarbons, said aromatic hydrocarbons being converted in step (b) into naphthenic hydrocarbons.

10. A method for obtaining products from polyolefin waste material or polyolefins, the method comprising the following steps in the order listed:

(a) thermally or catalytically decomposing polyolefin waste material or polyolefins to yield vapor products;

(b) fractionally condensing said vapor products into three fractions: a first fraction comprising compounds critically having boiling limits of below 280° C.; a second fraction comprising compounds critically having boiling limits of between 280° C. and 380° C.; and a third fraction comprising compounds critically having boiling limits of above 380° C.;

(c) independently subjecting said first fraction, said second fraction, and said third fraction to catalytic hydrogenation using a nickel catalyst until olefins contained in said fractions are hydrogenated yielding a first hydrogenated fraction, a second hydrogenated fraction, and a third hydrogenated fraction, respectively;

(d) fractionally distilling said first hydrogenated fraction to yield cosmetic kerosene having boiling limits of between 180° C. and 275° C.;

(e) fractionally distilling said second hydrogenated fraction to yield white oil having boiling limits between 270° C. and 380° C.; and (f) fractionally distilling said third hydrogenated fraction to yield paraffin having boiling limits between 380° C. and 620° C.

11. The method of claim 10, further comprising de-oiling paraffin obtained in (f) to yield low-oil paraffin having a solidification point of above 50° C. and having the content of oil of below 2% by weight.

12. A method for obtaining products from polyolefin waste material or polyolefins, the method comprising the following steps in the order listed:

(a) thermally or catalytically decomposing polyolefin waste material or polyolefins to yield vapor products, said vapor products comprising higher-boiling vapors having boiling limits above 400° C. and lower-boiling vapors having boiling limits between 70° C. and 400° C.;

(b) fractionally condensing and recycling said higher-boiling vapors;

(c) fractionally condensing said lower-boiling vapors into two fractions: a first fraction comprising compounds critically having boiling limits of below 270° C.; and a second fraction comprising compounds critically having boiling limits of between 270° C. and 390° C.;

(d) independently subjecting said first fraction, and said second fraction to catalytic hydrogenation using a nickel catalyst yielding a first hydrogenated fraction, and a second hydrogenated fraction, respectively;

(d) fractionally distilling said first hydrogenated fraction to yield cosmetic kerosene having boiling limits of between 180° C. and 275° C.; and (e) fractionally distilling said second hydrogenated fraction to yield white oil having boiling limits between 270° C. and 380° C.

13. The method of claim 12, further comprising fractionally distilling said first hydrogenated fraction to yield compounds having boiling limits of below 180° C. that are useful as components of fuels.

14. The method of claim 10, wherein if said first fraction, said second fraction, or said third fraction obtained in (b) contain sulfur, additionally removing said sulfur by hydrodesulfurization before (c).

15. The method of claim 12, wherein if said first fraction or said second fraction in (c) contain sulfur, additionally removing said sulfur by hydrodesulfurization before (d).

16. The method of claim 12, wherein by fractionally condensing and recycling said higher-boiling vapors in (b), significantly increasing ratio of C10-C16 hydrocarbons in said vapor products.

17. The method of claim 12, wherein by fractionally condensing and recycling said higher-boiling vapors in (b), significantly increasing ratio of C15-C25 hydrocarbons in said vapor products.

18. The method of claim 12, wherein by fractionally condensing and recycling said higher-boiling vapors in (b), significantly increasing ratio of hydrocarbons above C20 in said vapor products.

19. The method of claim 12, wherein said cosmetic kerosene and said white oil do not contain sulfur compounds, nitrogen compounds, aromatic hydrocarbons, or unsaturated hydrocarbons.

20. The method of claim 12, wherein fractional distillations in (d) and (e) are performed at atmospheric pressure.

* * * * *